US010437192B2

(12) United States Patent
Mizuguchi

(10) Patent No.: US 10,437,192 B2
(45) Date of Patent: Oct. 8, 2019

(54) SHEET FEEDER AND IMAGE FORMING DEVICE

(71) Applicant: KYOCERA Document Solutions Inc., Osaka-shi (JP)

(72) Inventor: Keisuke Mizuguchi, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 16/031,104

(22) Filed: Jul. 10, 2018

(65) Prior Publication Data

US 2019/0025747 A1 Jan. 24, 2019

(30) Foreign Application Priority Data

Jul. 18, 2017 (JP) ..... 2017-138793

(51) Int. Cl.
*B65H 1/04* (2006.01)
*B65H 1/26* (2006.01)
*G03G 15/00* (2006.01)

(52) U.S. Cl.
CPC ..... *G03G 15/6511* (2013.01); *B65H 1/04* (2013.01); *B65H 1/266* (2013.01); *B65H 2511/10* (2013.01); *B65H 2511/12* (2013.01)

(58) Field of Classification Search
CPC ..... B65H 2511/12; B65H 2511/11; B65H 2511/10; B65H 1/266; B65H 1/04; B65H 2402/5151; B65H 2405/1122; B65H 2405/1116; B65H 2405/114
See application file for complete search history.

(56) References Cited

U.S. PATENT DOCUMENTS

| | | | | |
|---|---|---|---|---|
| 8,393,615 | B1 * | 3/2013 | Hsu | B65H 1/04 271/171 |
| 8,496,243 | B2 * | 7/2013 | Nishioka | B65H 1/04 271/171 |
| 9,027,920 | B2 * | 5/2015 | Sato | B65H 1/04 271/171 |
| 9,567,171 | B2 * | 2/2017 | Iwama | B65H 1/04 |
| 9,821,968 | B2 * | 11/2017 | Nishioka | B65H 1/266 |
| 2015/0097330 | A1 | 4/2015 | Sato et al. | |

FOREIGN PATENT DOCUMENTS

| | | | |
|---|---|---|---|
| JP | 07101561 A | * | 4/1995 |
| JP | 2007153458 A | * | 6/2007 |
| JP | 2008001466 A | * | 1/2008 |
| JP | 2015-74518 | | 4/2015 |

* cited by examiner

*Primary Examiner* — Luis A Gonzalez
(74) *Attorney, Agent, or Firm* — Gerald E. Hespos; Michael J. Porco; Matthew T. Hespos

(57) ABSTRACT

A sheet feeder includes: a cassette main body; a side cursor; and a restriction part. The cassette main body houses a sheet to be fed in a predetermined sheet feeding direction. The side cursor is installed onto the cassette main body to be slidable in a sheet width direction perpendicular to the sheet feeding direction, and positions the sheet in the cassette main body. The restriction part increases sliding load of the side cursor with respect to the cassette main body when the side cursor slides and passes a standard size point that is a stopping position on the cassette main body when a sheet of a standard size is positioned.

4 Claims, 11 Drawing Sheets

SHEET FEEDER AND IMAGE FORMING DEVICE

INCORPORATION BY REFERENCE

The present application is based on Japanese Patent Application No. 2017-138793 filed with the Japan Patent Office on Jul. 18, 2017, the contents of which are hereby incorporated by reference.

BACKGROUND

The present disclosure relates to a sheet feeder that feeds sheets and an image forming device to which the sheet feeder is applied.

For example, an image forming device that forms images on sheets is equipped with a sheet feeder (sheet feeder cassette) that retains the sheets therein. The sheet feeder includes: a cassette main body that stores sheets; and a side cursor that positions the sheets inside the cassette main body. Sheets of various sizes are to be housed in the cassette main body. Accordingly, the side cursor is installed onto the cassette main body to be slidable in a sheet width direction.

The cassette main body includes a guide rail for guiding the sliding movement of the side cursor. Further, the side cursor includes a guide piece that is fitted into the guide rail, and moves in the sheet width direction along the guide rail.

SUMMARY

A sheet feeder according to an aspect of the present disclosure includes: a cassette main body; a side cursor; and a restriction part. The cassette main body houses a sheet to be fed in a predetermined sheet feeding direction. The side cursor is installed onto the cassette main body to be slidable in a sheet width direction perpendicular to the sheet feeding direction, and positions the sheet in the cassette main body. The restriction part increases sliding load of the side cursor with respect to the cassette main body when the side cursor slides and passes a standard size point that is a stopping position on the cassette main body when a sheet of a standard size is positioned.

An image forming device according to another aspect of the present disclosure includes: the above-described sheet feeder; and an image forming unit that forms an image on a sheet fed from the sheet feeder.

DETAILED DESCRIPTION

[Overall Configuration of Image Forming Device]

Figure 1:
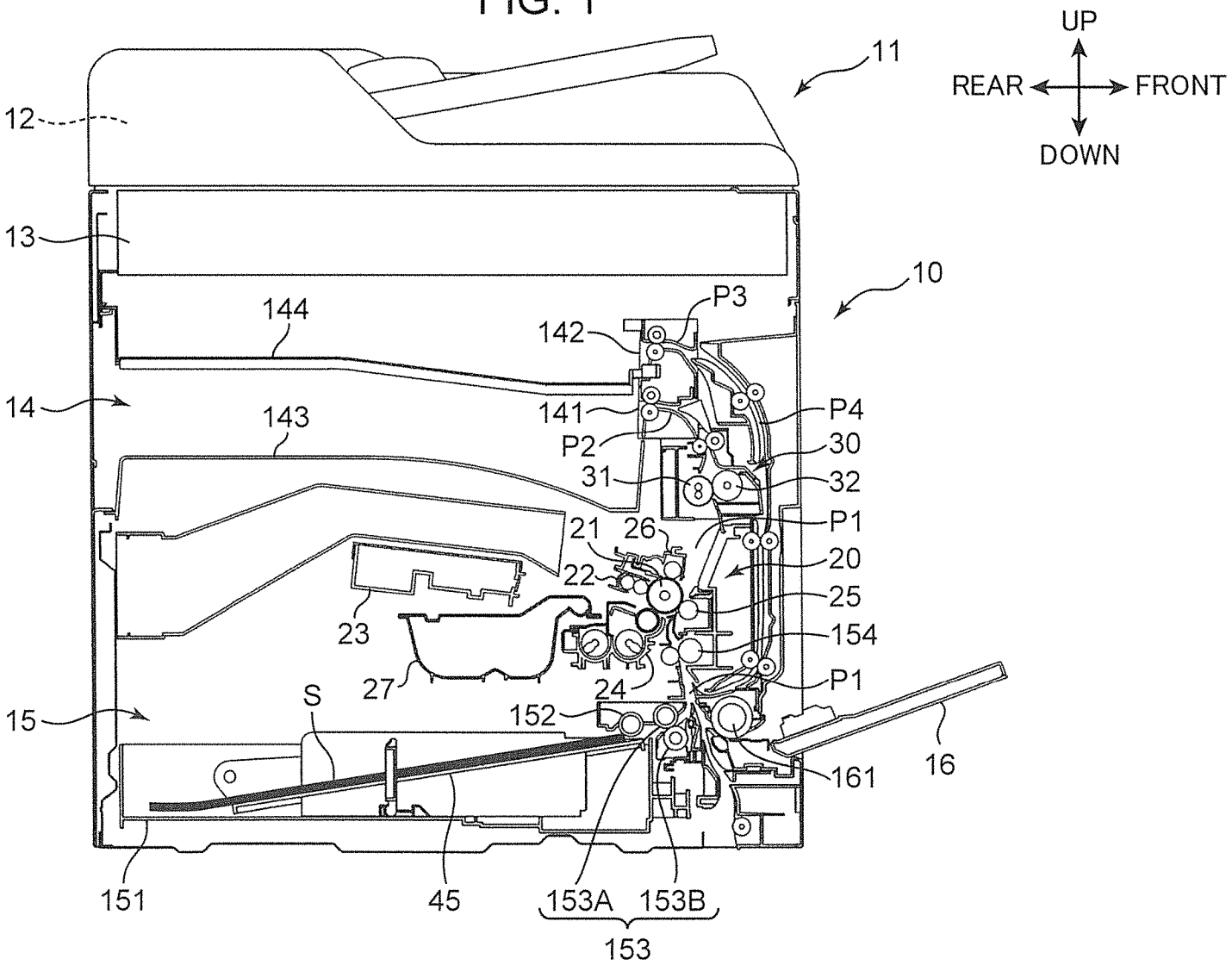
FIG. 1 is a schematic cross-sectional view of an image forming device according to an embodiment of the present disclosure.

In the following, detailed description is provided with regards to an embodiment of the present disclosure with reference to the drawings. FIG. 1 is a schematic cross-sectional view of an image forming device 1 according to the embodiment of the present disclosure. In the present embodiment, an electrophotographic monochromatic copier of the in-body sheet ejection type is described as the image forming device 1, for example. The image forming device 1 may for example be a color copier, a scanner, a facsimile device, or a multifunctional printer. Alternatively, the image forming device 1 may be an ink-jet image forming device. In the present embodiment, the image forming device 1 is described as an example of a device to which a sheet feeder according to the present disclosure is applied. However, the device to which the sheet feeder according to the present disclosure is applied may be a different device performing a different type of processing on sheets. In FIG. 1 and other figures, indications of up-down, left-right, and front-rear directions are provided. Note that these indications, however, are provided for convenience of description and do not limit the structure of the image forming device 1 in any way.

The image forming device 1 includes: a main body housing 10 having a substantially rectangular parallelepiped shape; and an automatic document feeder (ADF) 11 disposed on an upper surface of the main body housing 10. The main body housing 10 is a casing that houses various devices that perform image forming processing on sheets. The ADF 11 automatically conveys document sheets to be copied through an image reading position that is set at the upper surface of the main body housing 10. The ADF 11 has incorporated therein a conveyance mechanism 12 that conveys the document sheets, at the left side in the inside of the ADF 11. Further, at an upper part of the main body housing 10, a scanner 13 for optically reading (acquiring) images on document surfaces of the document sheets is disposed.

Below the scanner 13, an in-body sheet ejection unit 14 that houses sheets after image forming is provided. At a lower part of the main body housing 10, a sheet feeder unit 15 (sheet feeder) that houses sheets S to be subjected to image forming processing is disposed. A front-side wall of the main body housing 10 has attached thereto a manual-feed tray 16. The main body housing 10 has a first ejection port 141 and a second ejection port 142 that open toward a space in the in-body sheet ejection unit 14. Sheets ejected from the first ejection port 141 are received by an in-body sheet ejection tray 143. A secondary sheet ejection tray 144 is installed above the in-body sheet ejection tray 143. On the secondary sheet ejection tray 144, sheets ejected from the second ejection port 142 are stacked, or sheets being subjected to both-side printing are temporarily ejected for switchback conveyance.

In addition to the scanner 13 and the sheet feeder unit 15 described above, the main body housing 10 houses therein: an image forming unit 20; a fixing unit 30; and a sheet conveyance path. The image forming unit 20 forms images on sheets on the basis of image data output from the scanner 13. The image forming unit 20 includes a photoreceptor drum 21 and the following components disposed around the photoreceptor drum 21: a charger 22; an exposure device 23; a developing device 24; a transfer roller 25; and a cleaning device 26.

The photoreceptor drum 21 rotates about the shaft thereof and has a circumferential surface on which electrostatic latent images and toner images are formed. The charger 22 uniformly charges the circumferential surface of the photoreceptor drum 21. The exposure device 23 irradiates the circumferential surface of the photoreceptor drum 21 with laser light in order to form electrostatic latent images. The developing device 24 supplies toner onto the circumferential surface of the photoreceptor drum 21 in order to develop the electrostatic latent images formed on the photoreceptor drum 21. The transfer roller 25 forms a transfer nip part with the photoreceptor drum 21 and transfers toner images on the photoreceptor drum 21 onto sheets. The cleaning device 26 cleans the circumferential surface of the photoreceptor drum 21 after toner images have been transferred. A toner container 27 that supplies the developing device 24 with toner is disposed adjacent to the developing device 24.

The fixing unit 30 includes: a fixing roller 31 with a built-in heat source; and a pressurizing roller 32 that forms a fixing nip part together with the fixing roller 31. The fixing unit 30 performs fixing processing on sheets that have had toner images transferred thereon at the transfer nip part by applying heat and pressure onto the sheets at the fixing nip part. The sheets having been subjected to the fixing processing are ejected toward the in-body sheet ejection unit 14 from the first ejection port 141 or the second ejection port 142.

The sheet conveyance path includes a main conveyance path P1 extending in the up-down direction from near the lower part of the main body housing 10 to near the upper part of the main body housing 10 through the image forming unit 20 and the fixing unit 30. Near a downstream end of the main conveyance path P1, a first ejection conveyance path P2 that guides sheets to the first ejection port 141 branches off from the main conveyance path P1. Further, the most downstream end of the main conveyance path P1 has connected thereto a second ejection conveyance path P3 that guides sheets to the second ejection port 142. Further, a reversal conveyance path P4 that performs reversal conveyance of sheets upon both-side printing is disposed to extend from the most downstream end of the main conveyance path P1 to near an upstream end of the main conveyance path P1.

The sheet feeder unit 15 includes a sheet feeder cassette 151 that is detachably installed onto the main body housing 10. The sheet feeder cassette 151 houses a stack of sheets S onto which toner images are to be transferred. A sheet feeding direction of the sheets S is a front direction. The sheet feeder cassette 151 is described in detail later.

Near an upper front part of the sheet feeder cassette 151, a pick-up roller 152 and a sheet-feeding roller pair 153 are provided. The pick-up roller 152 draws out sheets at the uppermost layer of the sheet stack one by one, and the sheet-feeding roller pair 153 sends out the sheets onto the upstream end of the main conveyance path P1. The sheet-feeding roller pair 153 is constituted of: a sheet-feeding roller 153A; and a retard roller 153B. Sheets stacked on the manual-feed tray 16 are sent out onto the upstream end of the main conveyance path P1 by a manual-feed sheet-feeding roller 161. At a position further upstream than the image forming unit 20 along the main conveyance path P1, a resist roller pair 154 that sends out sheets to the transfer nip part at predetermined timings is disposed.

When a sheet is being subjected to single-side printing processing, the sheet is sent out onto the main conveyance path P1 from the sheet feeder cassette 151 or the manual-feed tray 16, and the sheet is subjected to transfer processing of a toner image at the image forming unit 20 and to fixing processing, in which the toner having been transferred onto the sheet is fixed to the sheet, at the fixing unit 30. Then, the sheet is conveyed through the first ejection conveyance path P2 to be ejected onto the in-body sheet ejection tray 143 from the first ejection port 141. Meanwhile, when a sheet is being subjected to both-side printing processing, after the transfer processing and fixing processing have been performed on one side of the sheet, the sheet is conveyed through the second ejection conveyance path P3 and a part thereof is ejected onto the secondary sheet ejection tray 144 from the second ejection port 142. Then, the sheet undergoes switchback conveyance and travels through the reversal conveyance path P4 to be returned to near the upstream end of the main conveyance path P1. Thereafter, the transfer processing and fixing processing are performed on the other side of the sheet, and the sheet is conveyed through the first ejection conveyance path P2 to be ejected onto the in-body sheet ejection tray 143 from the first ejection port 141.

[Details of Sheet Feeder Cassette]

Figure 2:
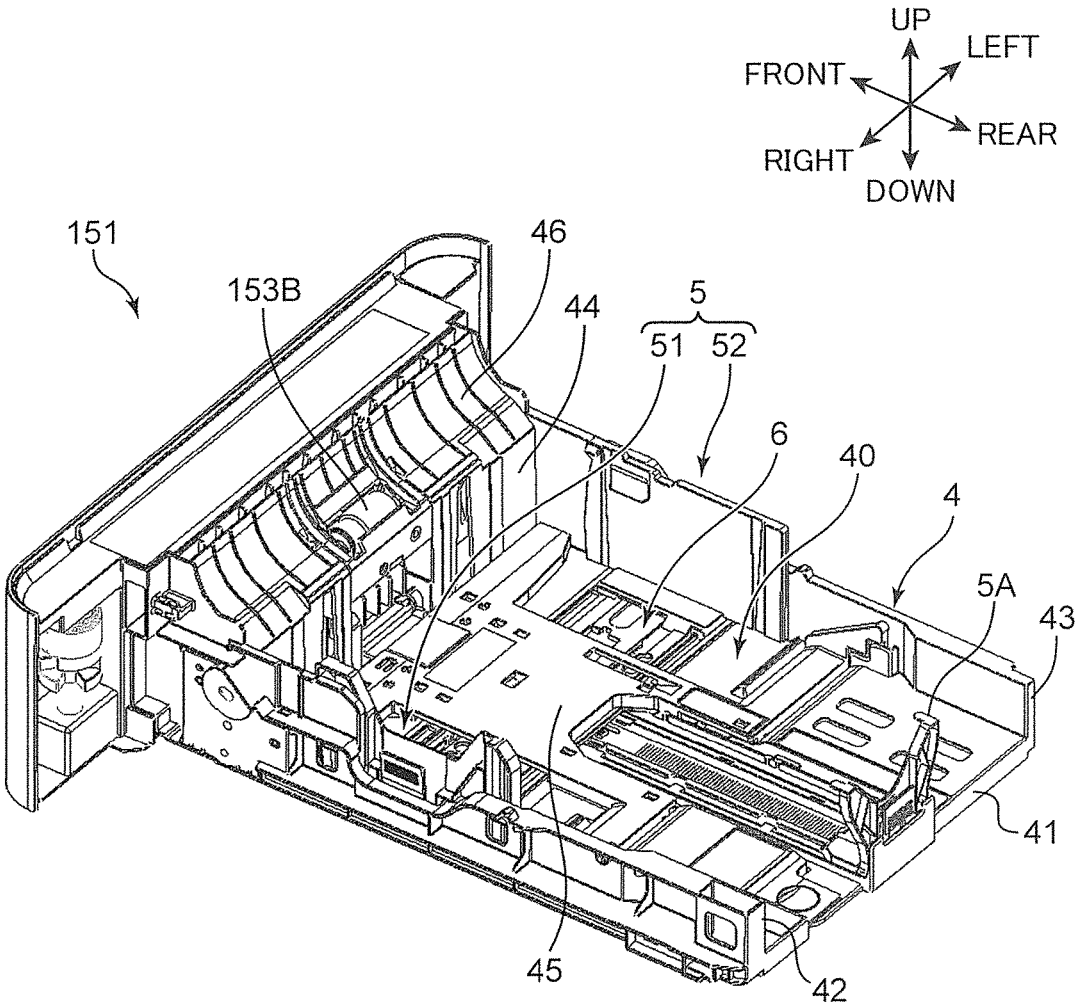
FIG. 2 is a perspective view of a sheet feeder cassette installed onto the image forming device.

FIG. 2 is a perspective view of the sheet feeder cassette 151. The sheet feeder cassette 151 has: a cassette main body 4 that houses sheets (sheet stack); and a side cursor 5 and a rear end cursor 5A that position the sheets housed in the cassette main body 4. The sheet feeder cassette 151 is installed onto the main body housing 10 so that the sheet feeder cassette 151 can be drawn out in the front direction. The sheets inside the cassette main body 4 are fed in the predetermined sheet feeding direction (front direction).

The cassette main body 4 has a shape of a rectangular box opening upward and has a sheet-housing space 40 for housing sheets (sheet stack). The cassette main body 4 has: a bottom plate 41; a right lateral plate 42; a left lateral plate 43; and a front wall 44, which are for demarcating the sheet-housing space 40. The bottom plate 41 forms a bottom surface of the sheet-housing space 40 and has a rectangular shape that is elongated in the front-rear direction in top view. The right lateral plate 42 and the left lateral plate 43 are erected upwards from a right-side edge of the bottom plate 41 and a left-side edge of the bottom plate 41, respectively. The front wall 44 is a vertical well erected at a front side of the bottom plate 41.

The cassette main body 4 is provided with a lift plate 45 that lifts up the sheets housed in the sheet-housing space 40. A rear end-side of the lift plate 45 is rotatably attached onto the bottom plate 41, and a front end-side of the lift plate 45 is lifted and lowered by a driving mechanism that is not illustrated. In FIG. 1, a state in which the lift plate 45 is lifting the front end-sides of the sheets S in the sheet feeding direction is illustrated. At an upper end of the front wall 44, a guide plate 46 which is curved is disposed to be continuous with the front wall 44. Sheets to be fed are drawn out along the guide plate 46 while being nipped by the sheet-feeding roller pair 153.

The side cursor 5 is installed onto the cassette main body 4 to be slidable in the sheet width direction (left-right direction), and positions left- and right-lateral parts of the sheets inside the cassette main body 4. The side cursor 5 is constituted of: a right cursor 51 (first cursor) disposed at the right-lateral part-side (one side in the sheet width direction) of the bottom plate 41; and a left cursor 52 (second cursor)

disposed at the left-lateral part-side (the other side) of the bottom plate 41. The right cursor 51 and the left cursor 52 contact the right-lateral parts and the left-lateral parts of the sheets housed in the sheet-housing space 40, respectively, and position the sheets in the width direction.

The rear-end cursor 5A is installed onto the cassette main body 4 to be slidable in a sheet transport direction (front-rear direction). The rear-end cursor 5A contacts rear end parts of the sheets housed in the sheet-housing space 40 and positions the sheets in the front-rear direction together with the front wall 44.

Figure 3:
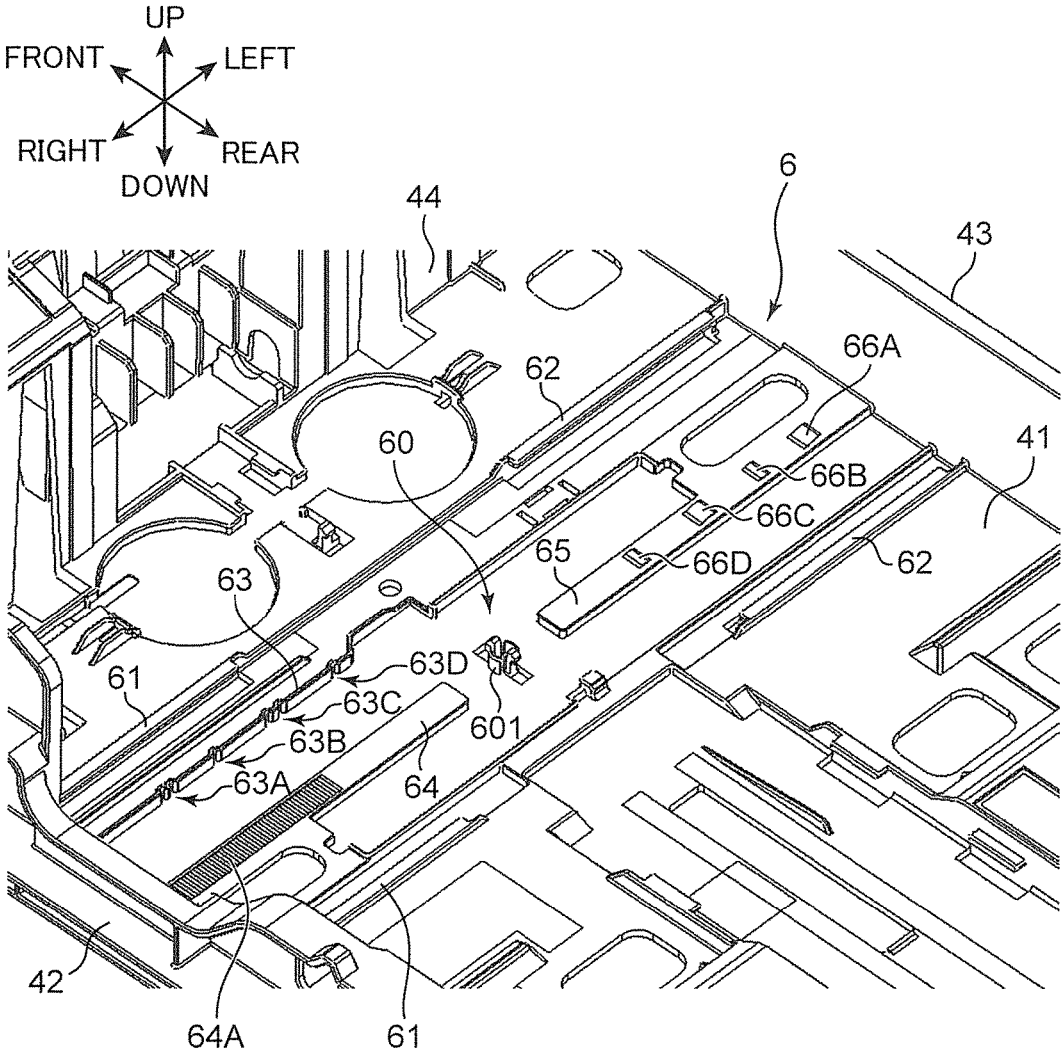
FIG. 3 is a perspective view of a main part of a bottom plate of a cassette main body in a state in which a side cursor has been removed.

The bottom plate 41 is provided with a side cursor arrangement part 6. The side cursor arrangement part 6 is for assembling the side cursor 5 (the right cursor 51 and the left cursor 52) in a slidable state onto the bottom plate 41. FIG. 3 is a perspective view of the bottom plate 41 in a state in which the side cursor 5 has been removed, and illustrates the side cursor arrangement part 6. The side cursor arrangement part 6 includes a slide surface 60 on which the side cursor 5 is mounted. The slide surface 60 is a belt-shaped surface that extends in the left-right direction at the upper surface of the bottom plate 41 with a width in accordance with the width of the side cursor 5 in the front-rear direction. A pinion boss 601 is erected at a center position of the slide surface 60 in the left-right and front-rear directions. A pinion 71 described later, is installed onto the pinion boss 601, and the pinion boss 601 serves as a rotation shaft of the pinion 71.

Figure 9:
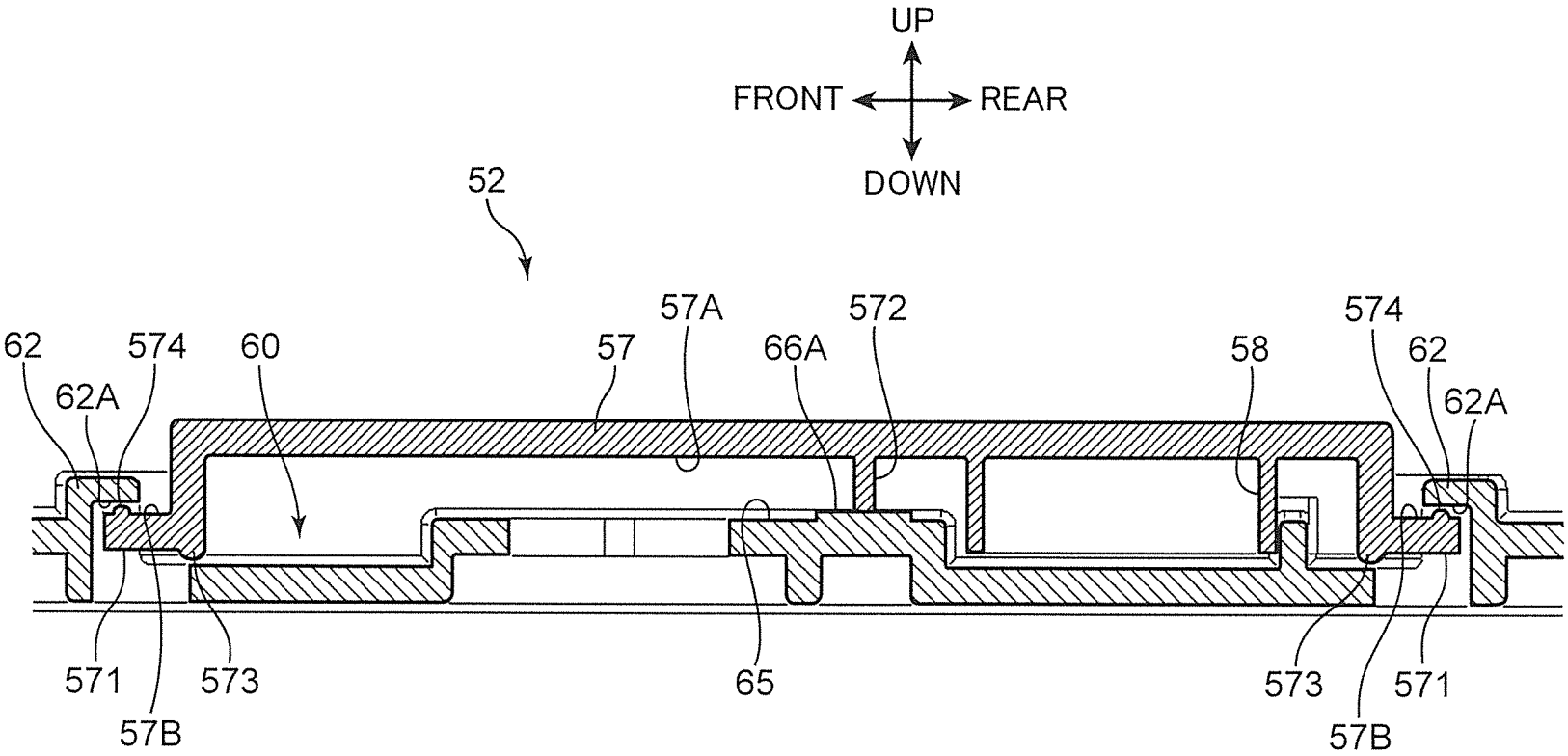
FIG. 9 is a cross-sectional view taken along line IX-IX in FIG. 7.

The side cursor arrangement part 6 includes: a pair of front and rear right rails 61; a pair of front and rear left rails 62; a wall part 63; a right linear projection 64 (fixing rack); and a left linear projection 65. The pair of right rails 61 extend in the sheet width direction (left-right direction) along a front-side edge and a rear-side edge of the slide surface 60 within a right-side area of the slide surface 60. The pair of left rails 62 extend in the left-right direction along the front-side edge and the rear-side edge of the slide surface 60 within a left-side area of the slide surface 60. As illustrated in FIG. 9, cross sections of the left rails 62 taken along the front-rear direction have inverted-L shapes (the same applies to the right rails 61). The right rails 61 and the left rails 62 guide the sliding movement of the right cursor 51 and the left cursor 52, respectively.

The wall part 63 is a standing wall extending in the left-right direction near the front-side edge of the slide surface 60. The wall part 63 is a wall surface that is parallel with the left-right direction, that is, a slide direction of the right cursor 51, and has formed therein a first recess 63A, a second recess 63B, a third recess 63C, and a fourth recess 63D, which are formed by recessing parts of the wall surface toward the front side. The first to fourth recesses 63A to 63D are provided so that a protruding piece 552 (FIG. 6) of a clicking feeling-provision part 55A described later, fits therein at standard size points that are stopping positions when the side cursor 5 positions sheets of standard sizes (for example, an A4 size, a B5 size, etc.). Note that while the second and fourth recesses 63B and 63D are each formed by one depression, the first and third recesses 63A and 63C are each formed by two adjacent depressions. This configuration is made in order to adapt to standard sizes that are similar in size to one another, such as the A4 size (210 mm×297 mm) and a letter size (215.9 mm×279.4 mm).

The right linear projection 64 is a linear projection provided to the cassette main body 4 to correspond to the right cursor 51. The right linear projection 64 extends from near a right end of the slide surface 60 to a position right before a center of the slide surface 60 in the left-right direction, near the center of the slide surface 60 in the front-rear direction. A cross-section of the right linear projection 64 taken along the front-rear direction has a rectangular shape elongated in the front-rear direction and the right linear projection 64 has a flat upper surface. An area of the upper surface that substantially corresponds to a right half has engraved therein gear teeth 64A constituted of a plurality of narrow grooves extending in the front-rear direction.

The left linear projection 65 is provided to correspond to the left cursor 52 and is a linear projection that extends from near a left end of the slide surface 60 to a position right before the center of the slide surface 60 in the left-right direction, near the center of the slide surface 60 in the front-rear direction. The left linear projection 65 and the right linear projection 64 line up in a straight line in the left-right direction. A right end surface of the left linear projection 65 and a left end surface of the right linear projection 64 face one another in a state in which the pinion boss 601 is sandwiched therebetween, spaced away from one another by a predetermined distance in which the pinion 71 (FIG. 4) can be disposed. A cross-section of the left linear projection 65 taken along the front-rear direction has a rectangular shape elongated in the front-rear direction and the left linear projection 65 has a flat upper surface.

On the upper surface of the left linear projection 65 (the slide surface 60), a first lower-side projection 66A, a second lower-side projection 66B, a third lower-side projection 66C, and a fourth lower-side projection 66D (second projections) are disposed in a protruding state. The first to fourth lower-side projections 66A to 66D function as a restriction part that increases a sliding resistance of the left cursor 52, with respect to the slide surface 60 (the cassette main body 4), only when the left cursor 52 passes the above-described standard size points during the sliding thereof. The first to fourth lower-side projections 66A to 66D are disposed to increase the restriction (sliding resistance) imposed on the left cursor 52 when the side cursor 5 is positioned at the respective standard size points of the first to fourth recesses 63A to 63D described above, respectively. Due to this, the first and third lower-side projections 66A and 66C respectively corresponding to the first and third recesses 63A and 63C, which are each formed by two adjacent recesses, have greater width in the left-right direction than the second and fourth lower-side projections 66B and 66D. Naturally, a modification may be made so that the first and third lower-side projections 66A and 66C are each formed by two adjacent protrusions.

Figure 4:
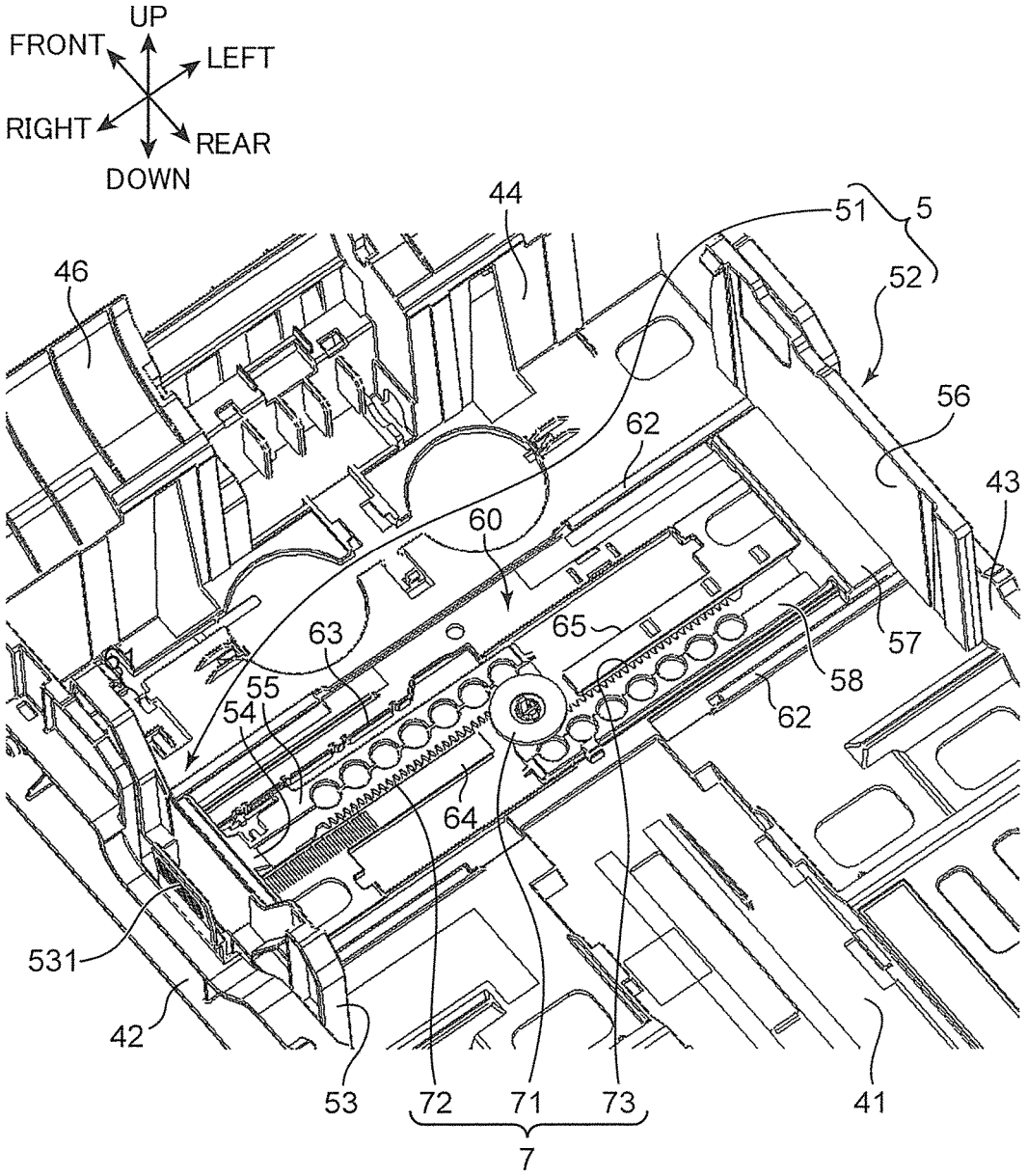
FIG. 4 is a perspective view of a main part of the bottom plate of the cassette main body in a state in which the side cursor has been installed.

FIG. 4 is a perspective view of the vicinity of the slide surface 60 of the bottom plate 41 in a state in which the side cursor 5 has been installed. In FIG. 4, the lift plate 45 illustrated in FIG. 2 has been removed. The right cursor 51 and the left cursor 52 are fitted into the right rails 61 and the left rails 62, respectively. Due to an interlocking mechanism 7, the right cursor 51 and the left cursor 52 slide in the left-right direction in an interlocked state toward one another and away from one another. In FIG. 4, a state in which the right cursor 51 and the left cursor 52 are most distant from one another is illustrated.

The interlocking mechanism 7 includes: the pinion 71; right rack teeth 72; and left rack teeth 73. The right rack teeth 72 and the left rack teeth 73 mesh with the pinion 71. The pinion 71 is rotatably fitted onto the pinion boss 601, which is erected on the slide surface 60. The right rack teeth 72 are gear teeth lining up in a straight line that are formed in a right rack plate 55 provided to the right cursor 51, and the left rack teeth 73 are gear teeth lining up in a straight line that are formed in a left rack plate 58 provided to the left cursor 52, respectively. For example, when an operator moves one of the right cursor 51 and the left cursor 52 in the state illustrated in FIG. 4 toward a center of the bottom plate 41, the other one of the right cursor 51 and the left cursor 52 also moves toward the center in the interlocked state due to the interlocking mechanism 7.

[Side Cursor Details/Right Cursor]

Figure 5:
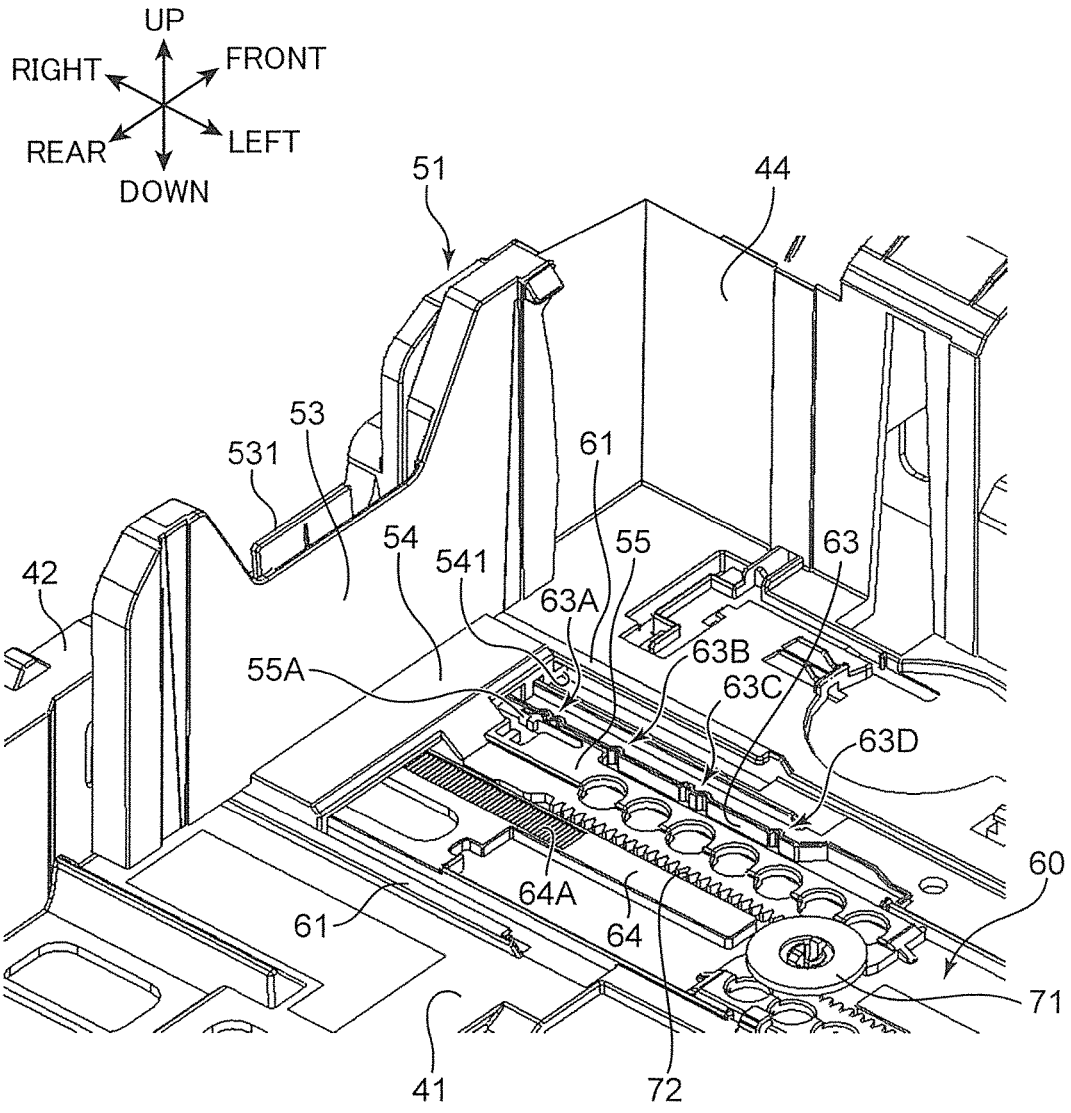
FIG. 5 is an enlarged perspective view of a part at which a right cursor is installed.
Figure 6:
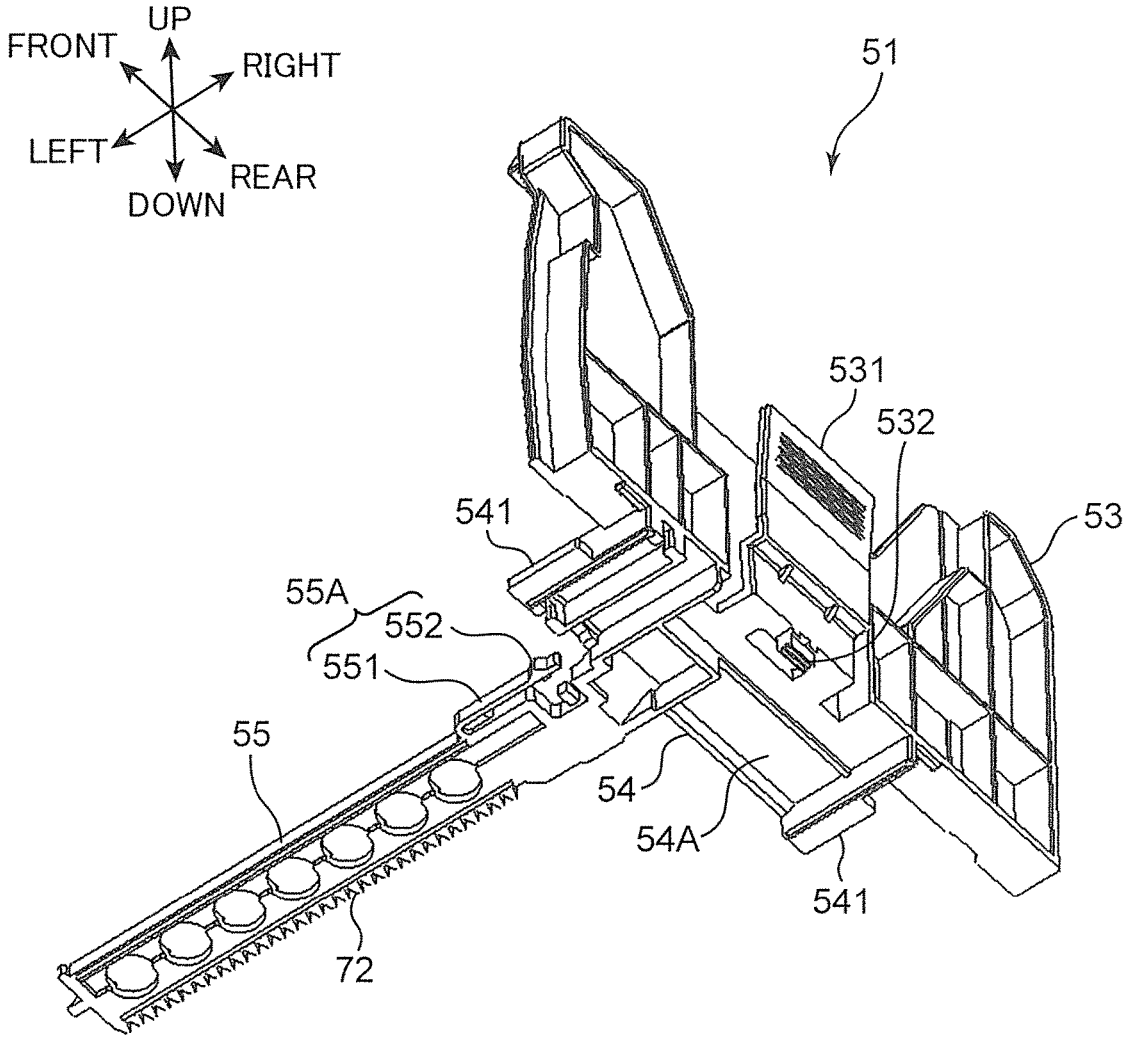
FIG. 6 is a perspective view of the right cursor alone seen from below.

Subsequently, the side cursor 5 is described in detail. FIG. 5 is an enlarged perspective view of the part at which the right cursor 51 is installed onto the bottom plate 41, and FIG. 6 is a perspective view of the right cursor 51 alone seen from below. The right cursor 51 includes: a right cursor plate 53; a right base plate 54; the right rack plate 55; and the clicking feeling-provision part 55A.

The right cursor plate 53 is a plate member that is put in a state of being erected vertically upward with respect to the bottom plate 41 and allows positioning of the right-lateral parts of sheets to be performed. The positioning is carried out by an inner surface-side of the right cursor plate 53 contacting or coming near the right-lateral parts of the sheets. The right cursor plate 53 has mounted thereonto a lock lever 531 for fixing the right cursor 51 to the bottom plate 41. An engaging piece 532 having a tooth shape is disposed in the protruding state on a lower end of the lock lever 531. The engaging piece 532 is capable of engaging with the gear teeth 64A of the right linear projection 64, which are disposed at the bottom plate 41, and the right cursor 51 is fixed to the bottom plate 41 when this engagement is established.

The lock lever 531, at the lower end thereof, is swingably connected with respect to the right cursor plate 53. When the lock lever 531 is swung toward the right cursor plate 53, the engaging piece 532 is lifted upward. When the lock lever 531 is not swung, the engaging piece 532 settles down on the gear teeth 64A and the movement of the right cursor 51 in the left-right direction is restricted due to the engagement between the engaging piece 532 and the gear teeth 64A. Accordingly, the operator can slide the side cursor 5 in the left-right direction by nipping the lock lever 531 and thereby releasing the engagement between the engaging piece 532 and the gear teeth 64A.

The right base plate 54 is a plate member extending horizontally from the lower end of the right cursor plate 53 toward the left. A width of the right base plate 54 in the front-rear direction is approximately the same as a width of the slide surface 60 in the front-rear direction, and the right base plate 54 has a lower surface 54A that faces the slide surface 60. Step parts are provided at both end edges of the right base plate 54 in the front-rear direction, and guide pieces 541 are disposed to protrude horizontally outward from the respective step parts. The pair of guide pieces 541 are linear projections extending in the left-right direction, and are fitted into the respective ones of the pair of right rails 61, which are provided to the bottom plate 41. When the right cursor 51 slides in the left-right direction, the pair of guide pieces 541 are guided by the pair of right rails 61.

The right rack plate 55 is a plate member having an elongated rectangular shape, and extends horizontally from a left end of the right base plate 54 further toward the left. The right rack teeth 72 described above are engraved in a rear-side lateral edge of the right rack plate 55. In a state in which the right cursor 51 has been assembled onto the bottom plate 41, the right rack plate 55 is located between the wall part 63 and the right linear projection 64 and the right rack teeth 72 engage with the pinion 71, as illustrated in FIG. 5.

The clicking feeling-provision part 55A is disposed in order to provide the operator sliding the right cursor 51 (the side cursor 5) with a clicking feeling at the standard size points, which are the stopping positions when sheets of standard sizes are positioned. The clicking feeling-provision part 55A is provided at a front-side lateral edge of the right rack plate 55 near a base (near the right end) of the right rack plate 55, and includes: an elastic arm 551; and the protruding piece 552. The elastic arm 551 is an L-shaped arm one end of which is connected to the right rack plate 55 and the other end (tip) of which is a free end. In detail, the L-shape is constituted of: a portion that slightly protrudes toward the front from the front-side edge of the right rack plate 55; and a portion that extends in parallel with the right rack plate 55 from the protruding end and further toward the right. The protruding piece 552 is formed to protrude toward the front from the tip of the elastic arm 551.

The protruding piece 552 contacts the wall part 63 and is capable of fitting into the first to fourth recesses 63A to 63D of the wall part 63. When the protruding piece 552 contacts the wall part 63, the elastic arm 551 undergoes elastic deformation toward the front-side edge of the right rack plate 55. Due to this, the protruding piece 552 contacts the wall part 63 in a state of being biased by elastic repulsive force of the elastic arm 551. Meanwhile, at positions at which the protruding piece 552 faces the first to fourth recesses 63A to 63D, the elastic repulsive force is released and the protruding piece 552 fits into one of the first to fourth recesses 63A to 63D.

As described above, the operator nips the lock lever 531 and slides the right cursor 51 in the left-right direction. A clicking feeling is provided to the operator by the elastic repulsive force being released due to the protruding piece 552 fitting into the first to fourth recesses 63A to 63D when the right cursor 51 passes the standard size points during this sliding movement of the right cursor 51. Provided with this clicking feeling, the operator is capable of knowing that the side cursor 5 is at positions for positioning sheets of standard sizes.

[Side Cursor Details/Left Cursor]

Figure 7:
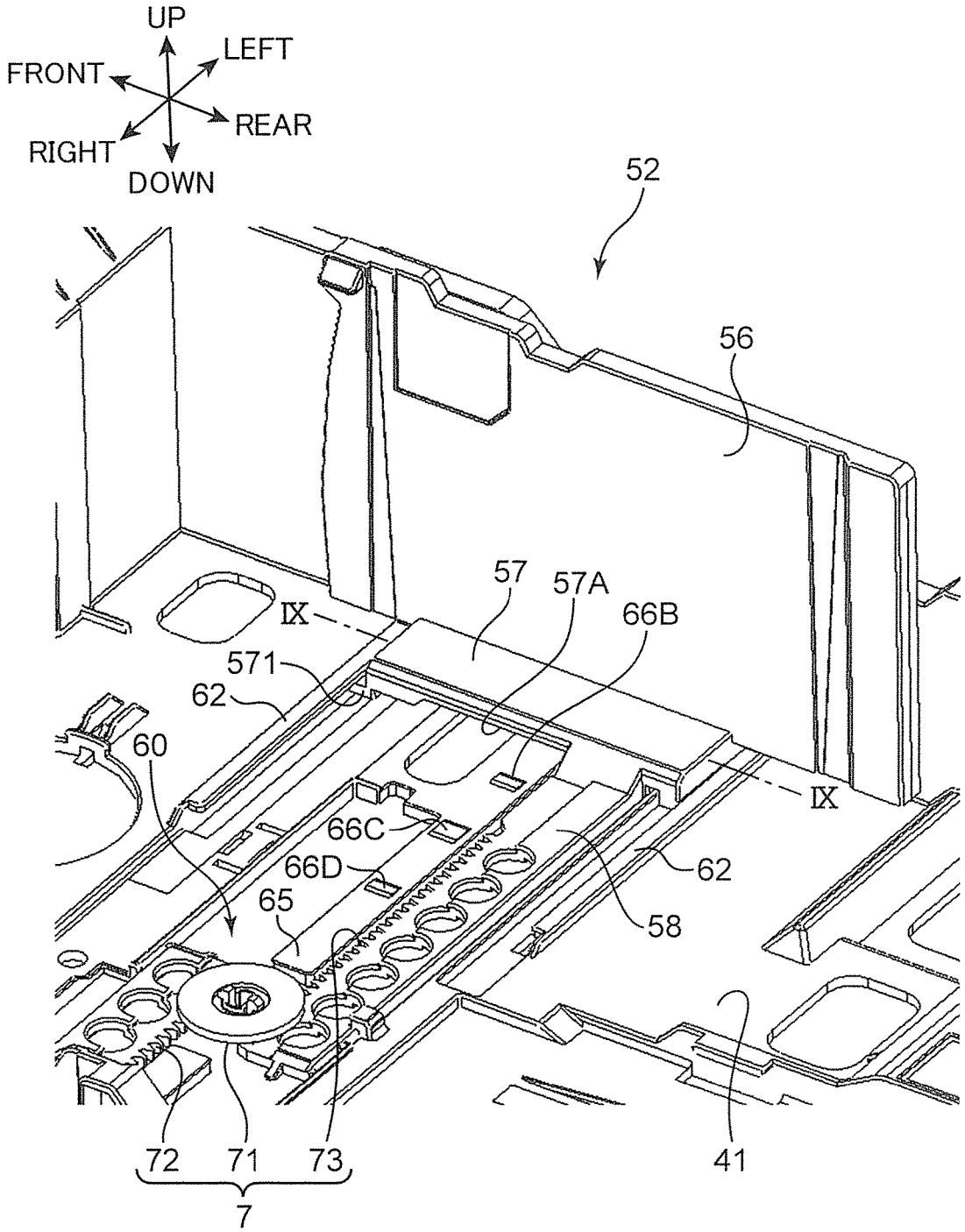
FIG. 7 is an enlarged perspective view of a part at which a left cursor is installed.
Figure 8:
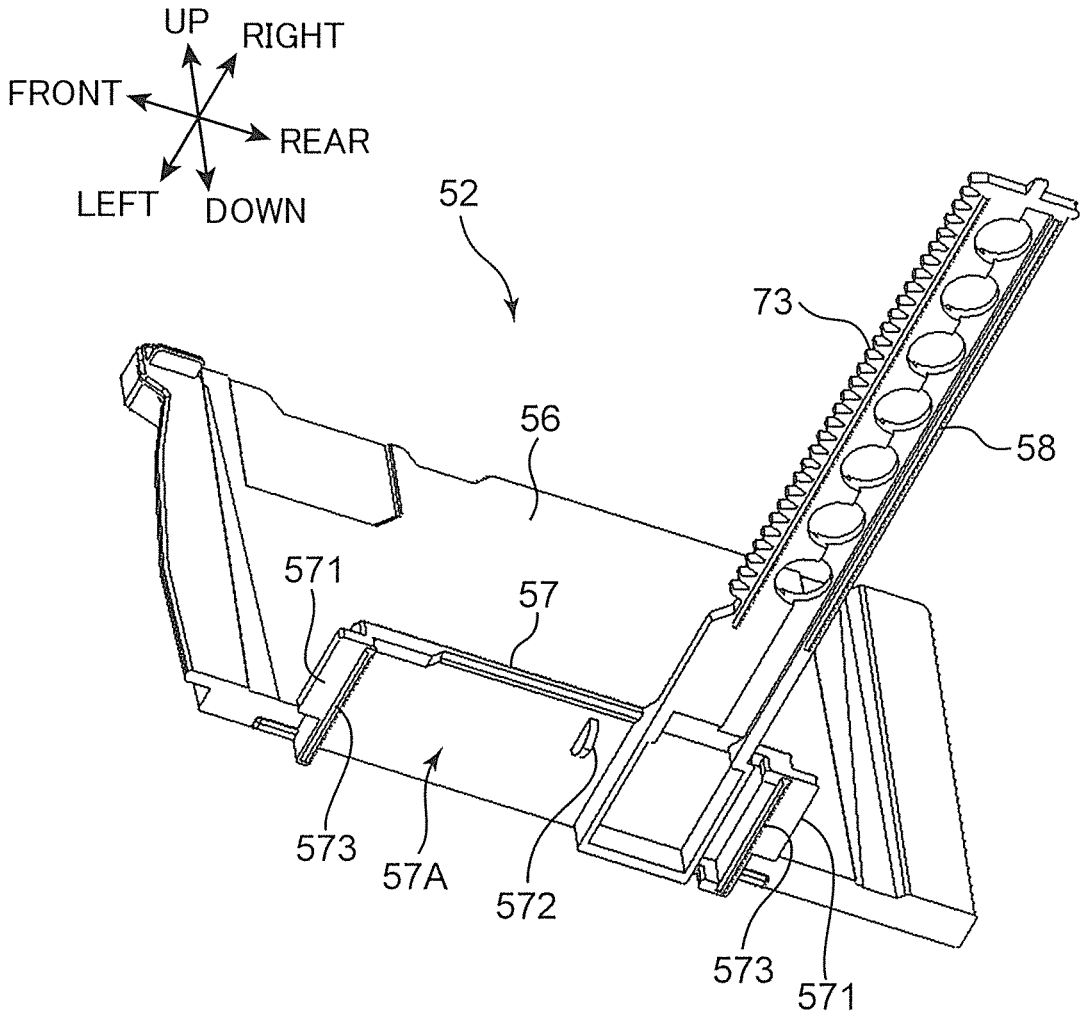
FIG. 8 is a perspective view of the left cursor alone seen from below.

FIG. 7 is an enlarged perspective view of the part at which the left cursor 52 is installed onto the bottom plate 41, and FIG. 8 is a perspective view of the left cursor 52 alone seen from below. The left cursor 52 includes: a left cursor plate 56; a left base plate 57; and the left rack plate 58.

The left cursor plate 56 is a plate member that is put in a state of being erected vertically upward with respect to the bottom plate 41 and allows positioning of the left-lateral parts of sheets to be performed. The positioning is carried out by the inner surface-side of the left cursor plate 56 contacting or coming near the left-lateral parts of the sheets. Note that the left cursor plate 56 does not have mounted thereonto the lock lever 531 provided to the right cursor plate 53 or the like.

The left base plate 57 is a plate member extending horizontally from the lower end of the left cursor plate 56 toward the right. A width of the left base plate 57 in the front-rear direction is approximately the same as a width of the slide surface 60 in the front-rear direction, and the left base plate 57 has a lower surface 57A that faces the slide surface 60. Step parts are provided at both end edges of the left base plate 57 in the front-rear direction, and guided pieces 571 are formed to protrude horizontally outward from the respective step parts. The pair of guided pieces 571 are linear projections extending in the left-right direction, and are fitted into the respective ones of the pair of left rails 62, which are provided to the bottom plate 41. When the left cursor 52 slides in the left-right direction, the pair of guided pieces 571 are guided by the pair of left rails 62.

The left rack plate 58 is a plate member having an elongated rectangular shape, and extends horizontally from the right end of the left base plate 57 further toward the right. The left rack teeth 73 described above are engraved in the rear-side lateral edge of the left rack plate 58. In a state in which the left cursor 52 has been assembled onto the bottom plate 41, the left rack plate 58 is adjacent to a rear side of the left linear projection 65 and the left rack teeth 73 engage with the pinion 71, as illustrated in FIG. 7.

In addition to the above, the left cursor 52 (the left base plate 57) is provided with shape-related features for increasing the restriction (sliding resistance) of the left cursor 52, with respect to the bottom plate 41. This point is described by additionally referring to FIG. 9, which is a cross-sectional view taken along line IX-IX in FIG. 7. In addition to the guided pieces 571 described above, the left base plate 57 includes: an upper-side projection 572 (restriction part/first projection); lower ribs 573; and upper ribs 574.

The upper-side projection 572 is a projection formed to protrude downward from the lower surface 57A of the left base plate 57. The upper-side projection 572 is disposed in the front-rear direction at a position matching the positions at which the first to fourth lower-side projections 66A to 66D (restriction part/second projection) of the bottom plate 41 are disposed. That is, the upper-side projection 572 is disposed in the protruding state on the lower surface 57A at a position such that, when the left cursor 52 slides in the left-right direction, the upper-side projection 572 passes over the part of the upper surface of the left linear projection 65 at which the first to fourth lower-side projections 66A to 66D are arrayed.

Due to this, when the side cursor 5 (the left cursor 52) is located at a slide position at which the side cursor 5 passes one of the standard size points described above, the upper-side projection 572 and the one of the first to fourth lower-side projections 66A to 66D would overlap one another in the up-down direction. In FIG. 9, a state in which the upper-side projection 572 and the first lower-side projection 66A overlap one another in the up-down direction, that is, a state in which the upper-side projection 572 has landed on the first lower-side projection 66A and the left base plate 57 (the left cursor 52) is being lifted upward, is illustrated. Other than at the standard size points, the upper-side projection 572 and the first to fourth lower-side projections 66A to 66D do not overlap one another in the up-down direction, and rather, the lower end of the upper-side projection 572 confronts the upper surface of the left linear projection 65, and the upward lifting of the left base plate 57 (the left cursor 52) is not carried out.

The lower ribs 573 are formed in the protruding state on the lower surfaces of the respective ones of the pair of front and rear guided pieces 571. As illustrated in FIG. 8, the lower ribs 573 are elongated linear projections extending in the left-right direction, and are provided for reducing a contact area (reducing sliding resistance) between the slide surface 60 and the left base plate 57 by forming line contact. In a state in which the lifting of the left base plate 57, which occurs due to the upper-side projection 572 contacting the first to fourth lower-side projections 66A to 66D, is not occurring, the lower ribs 573 mainly contacts the slide surface 60.

The upper ribs 574 are formed in the protruding state on the upper surfaces of the respective ones of the pair of front and rear guided pieces 571. The upper ribs 574 are also elongated linear projections extending in the left-right direction, while illustration thereof is not provided. As illustrated in FIG. 9, the lower surfaces of the horizontal portions of the left rails 62 serve as guiding surfaces 62A that restrict the movement of the guided pieces 571 of the left cursor 52 in the up-down direction and guide the sliding of the left cursor 52. Meanwhile, the upper surfaces of the guided pieces 571 serve as guided surfaces 57B that are guided by the guiding surfaces 62A. The guided surfaces 57B face the guiding surfaces 62A across gaps therebetween. That is, the guided pieces 571 are fitted into the left rails 62 with suitable play therebetween in the up-down direction. The upper ribs 574 are linear projections protruding upward from the guided surfaces 57B, and form a state of line contact with respect to the guiding surfaces 62A when force that presses the guided surfaces 57B against the guiding surfaces 62A acts. Note that the movement of the guided pieces 571 in the front-rear direction is restricted by rail walls that are the vertical portions of the left rails 62.

[Action for Restricting Left Cursor]

Figure 10A:
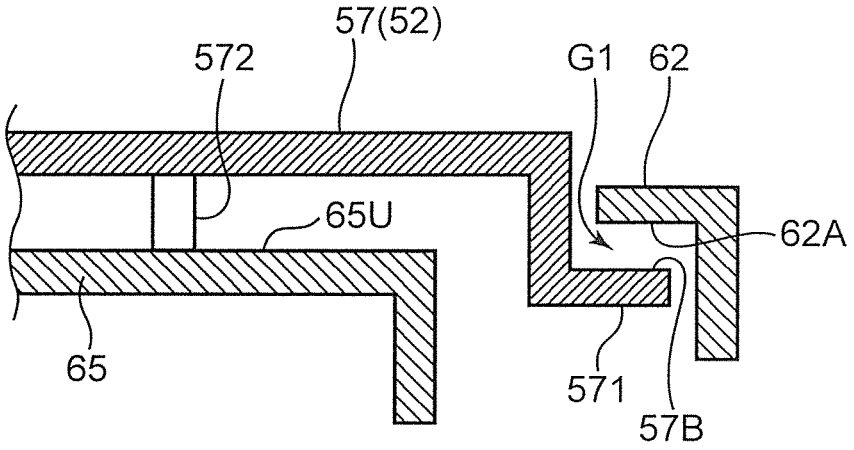
FIGS. 10A and 10B are schematic views for describing states of the left cursor during sliding.
Figure 10B:
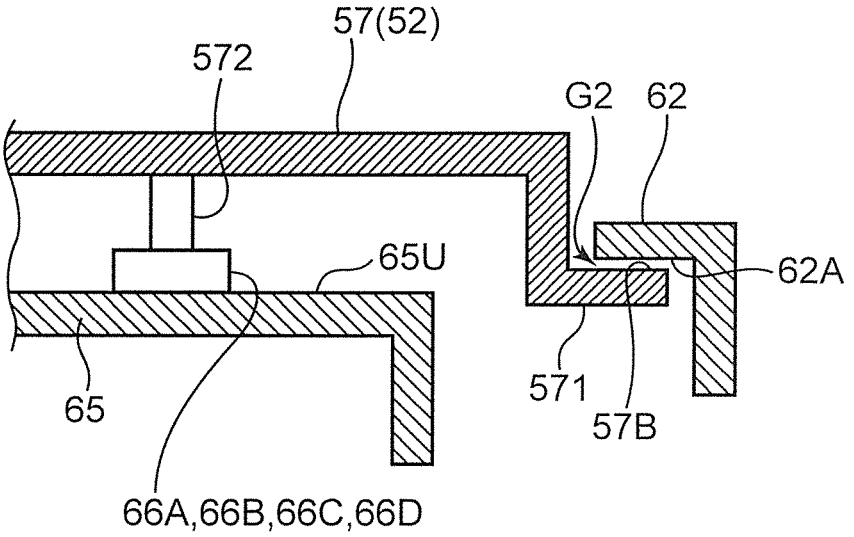
Figure 11:
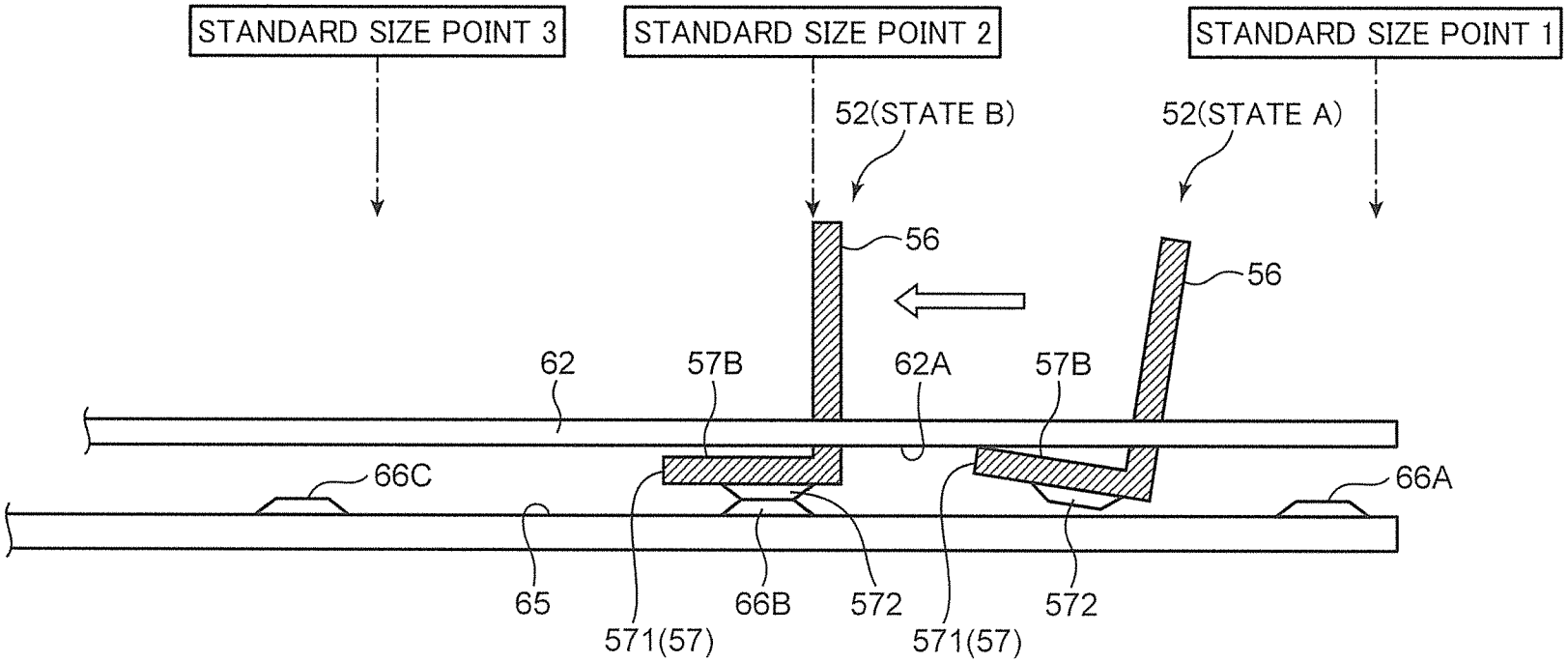
FIG. 11 is a schematic view for describing a restricted state of the left cursor.

Subsequently, description is provided of an action through which the restriction (sliding resistance) imposed on the left cursor 52 is increased at the standard size points by the restriction part constituted of the structure formed by the upper-side projection 572 and the first to fourth lower-side projections 66A to 66D. FIGS. 10A and 10B are schematic views for describing states of the left cursor 52 during sliding, and FIG. 11 is a schematic view for describing the restricted state of the left cursor 52. In these figures, the left base plate 57 is illustrated in simplified state and the lower ribs 573 and the upper ribs 574 are not illustrated.

FIG. 10A illustrates the relation of the left base plate 57 with respect to the left rail 62 and the left linear projection 65, in a case in which the left cursor 52 is located at a slide position other than the standard size points. In this case, the upper-side projection 572 does not overlap any one of the first to fourth lower-side projections 66A to 66D in the up-down direction. Due to this, the lower end of the upper-side projection 572 contacts the upper surface (upper surface 65U) of the left linear projection 65, or comes near the upper surface 65U when the lower ribs 573 contact the slide surface 60 (FIG. 9). That is, the left base plate 57 is in a state of not being lifted upward. Accordingly, a relatively large gap G1 is formed between the guiding surface 62A of the left rail 62 and the guided surface 57B of the guided piece 571. In this state, force of restriction (sliding resistance) imposed on the left cursor 52, with respect to the bottom plate 41, is relatively weak.

FIG. 10B illustrates the relation of the left base plate 57 with respect to the left rail 62 and the left linear projection 65, in a case in which the left cursor 52 is located at a slide position at which the left cursor 52 passes one of the standard size points. In this case, the upper-side projection 572 overlaps one of the first to fourth lower-side projections 66A to 66D in the up-down direction. That is, the lower end of the upper-side projection 572 contacts the upper surface of the one of the first to fourth lower-side projections 66A to 66D. Due to this, the left base plate 57 is put in the state of being lifted upward, and the gap between the guiding surface 62A and the guided surface 57B is narrowed from the gap G1 to a relatively narrow gap G2. In this state, margin of looseness of the left cursor 52 with respect to the left rails 62 is suppressed. Due to this, the guiding surface 62A and the guided surface 57B are more likely to come in contact, whereby the sliding resistance is increased and the force of restriction imposed on the left cursor 52, with respect to the bottom plate 41, is strengthened.

In FIG. 11, the stopping position of the left cursor 52 due to the first lower-side projection 66A (one of the second projection) is indicated as "standard size point 1". Further, the second lower-side projection 66B and the third lower-side projection 66C are indicated as "standard size point 2" and "standard size point 3", respectively. The left cursor 52 indicated by "state A" in FIG. 11 corresponds to the slide position of the left cursor 52 in FIG. 10A. In FIG. 11, illustration is provided of a state in which the left cursor 52 is located between "standard size point 1" and "standard size point 2" as an example. As described above, the relatively large gaps G1 are formed between the guiding surfaces 62A and the guided surfaces 57B in this state, and thus, the looseness of the left cursor 52 with respect to the left rails 62 is great. Accordingly, the left cursor 52 easily tilts in this state.

Meanwhile, the left cursor 52 indicated by "state B" in FIG. 11 corresponds to the slide position of the left cursor 52 in FIG. 10B. Here, illustration is provided of a state in which the upper-side projection 572 on the guided piece 571 is contacting the second lower-side projection 66B at "standard size point 2". Due to this contact, the gaps between the guiding surfaces 62A and the guided surfaces 57B are narrowed so that the relatively narrow gaps G2 only exist. Due to this, the restriction imposed on the left cursor 52, with respect to the bottom plate 41, is increased, and the left cursor 52 is put in a state such that tilting of the left cursor 52 is unlikely to occur. Accordingly, sheets can be accurately positioned at "standard size point 2".

[Actions and Effects]

According to the sheet feeder cassette 151 of the present embodiment, the clicking feeling-provision part 55A is provided to the right cursor 51. Due to this, the operator can easily cause the side cursor 5 to carry out positioning of sheets of standard sizes by, while sliding the side cursor 5, stopping the sliding at slide positions at which a clicking feeling can be felt, or that is, at the standard size points described above. Further, the restriction part constituted of the structure formed by the upper-side projection 572 and the first to fourth lower-side projections 66A to 66D is provided. Accordingly, the sliding resistance of the side cursor 5 increases when the side cursor 5 is stopped at the standard size points. Thus, tilting of the side cursor 5 becomes unlikely, whereby it is possible to cause the side cursor 5 to carry out positioning of sheets at the standard size points in an excellent manner and the occurrence of sheet skewing can be prevented.

As for the operation feeling that the operator feels when sliding the side cursor 5, the operational feeling is relatively light at slide positions other than the standard size points and is relatively heavy at the standard size points and the vicinity thereof due to the contact between the upper-side projection 572 and one of the first to fourth lower-side projections 66A to 66D. That is, the sliding resistance increases to make the operation feeling heavy only when the side cursor 5 passes the standard size points. Due to this, it is not the case that the operation feeling while sliding the side cursor 5 is made heavy at all times, and no deterioration in operability is brought about.

Further, the left cursor 52 slides in the left-right direction in a state in which the guided pieces 571 are guided by the left rails 62. During this sliding, gaps are secured between the guiding surfaces 62A of the left rails 62 and the guided surfaces 57B of the guided pieces 571, and thus, the operator is able to move the left cursor 52 (the side cursor 5) smoothly. Further, the gaps are narrowed when the left cursor 52 is located at the slide positions at which the left cursor 52 passes the standard size points. Looseness of the left cursor 52 is suppressed by using such a simple structure. That is, the restriction imposed on the left cursor 52 is increased, whereby tilting of the left cursor 52 can be prevented.

Further, the clicking feeling-provision part 55A is provided to correspond to the right cursor 51, and the restriction part constituted of the structure formed by the upper-side projection 572 and the first to fourth lower-side projections 66A to 66D is provided to correspond to the left cursor 52. With regards to the right cursor 51, the restriction imposed on the right cursor 51, with respect to the bottom plate 41, can be increased by the engagement between the gear teeth 64A of the right linear projection 64 and the engaging piece 532 of the lock lever 531. Due to this, tilting of the right cursor 51 can be prevented at slide positions at which a clicking feeling can be felt due to the clicking feeling-provision part 55A. Meanwhile, with regards to the left cursor 52, tilting of the left cursor 52 can be prevented by the restriction part, without applying an engagement structure in which the lock lever 531 is used. Accordingly, tilting of each of the cursors 51 and 52 at the standard size points can be prevented in a side cursor in which the pair of the right cursor 51 and the left cursor 52 move in the interlocked state due to the interlocking mechanism 7.

[Modifications]

Up to this point, description is provided of an embodiment of the present disclosure. The present disclosure, however, is not limited to this, and modified embodiments such as those below can be carried out, for example.

(1) In the embodiment above, description is provided of an example in which the restriction part is constituted of the structure formed by the upper-side projection 572 and the first to fourth lower-side projections 66A to 66D. The restriction part may take various forms, as long as the sliding resistance of the side cursor 5, with respect to the cassette main body 4, is increased only when the side cursor 5 passes the standard size points. For example, a form may be made in which the left rack plate 58 is provided with an arm member similar to the elastic arm 551 described with the clicking feeling-provision part 55A as an example, a wall surface facing the arm member is erected on the bottom plate 41, and projections similar to the first to fourth lower-side projections 66A to 66D are formed on the wall surface.

(2) In the embodiment above, description is provided of an example in which the restriction part increasing the sliding resistance of the side cursor 5 is provided only to the left cursor 52. Alternatively, the restriction part may be provided to both the right cursor 51 and the left cursor 52.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A sheet feeder comprising:

a cassette main body that houses a sheet to be fed in a predetermined sheet feeding direction;

a side cursor that is installed onto the cassette main body to be slidable in a sheet width direction perpendicular to the sheet feeding direction and that positions the sheet in the cassette main body; and a restriction part that increases sliding load of the side cursor with respect to the cassette main body when the side cursor slides and passes a standard size point that is a stopping position on the cassette main body when a sheet of a standard size is positioned, wherein the cassette main body includes a slide surface on which the side cursor is mounted and is provided with a rail that extends in the sheet width direction, the rail has a guiding surface that guides a sliding of the side cursor, the side cursor includes a lower surface that faces the slide surface and further includes a guided piece that is guided by the guide rail, the guided piece including a guided surface that faces the guiding surface across a predetermined gap, the restriction part is a structure that narrows the gap when the side cursor passes the standard size point, the restriction part includes a structure having:

a first projection disposed on the lower surface in a protruding state; and a second projection disposed to protrude from the slide surface, the second projection disposed at a position such that the second projection overlaps the first projection in an up-down direction when the side cursor passes the standard size point, and the predetermined gap is narrowed by contact between the first projection and the second projection.

2. The sheet feeder according to claim 1, wherein the side cursor includes: a first cursor disposed at one side in the sheet width direction; and a second cursor that is disposed at the other side in the sheet width direction, the sheet feeder further comprising:

a clicking feeling-provision part that, at the standard size point, provides a clicking feeling to an operator sliding the side cursor, the clicking feeling-provision part includes: an elastic arm extending from the first cursor; and a protruding piece disposed at a tip of the elastic arm in a protruding state, the protruding piece fitting into a recess provided in a wall part erected on the cassette main body.

3. The sheet feeder according to claim 2, further comprising:

an interlocking mechanism that is provided on the cassette main body to cause the first cursor and the second cursor to move in an interlocked state toward one another and away from one another;

a fixing rack disposed in the cassette main body to correspond to the first cursor and having gear teeth for fixing; and an engaging piece that is provided on the first cursor to engage with the gear teeth, the clicking feeling-provision part is provided to correspond to the first cursor, and the restriction part is provided to correspond to the second cursor.

4. An image forming device comprising:

the sheet feeder according to claim 1; and an image forming unit that forms an image on a sheet fed from the sheet feeder.

* * * * *